US006503155B2

(12) United States Patent
Maruko et al.

(10) Patent No.: US 6,503,155 B2
(45) **Date of Patent: *Jan. 7, 2003**

(54) GOLF BALL

(75) Inventors: Takashi Maruko, Saitama (JP); Hisashi Yamagishi, Saitama (JP); Yutaka Masutani, Saitama (JP)

(73) Assignee: Bridgestome Sports Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/779,675

(22) Filed: Feb. 9, 2001

(65) Prior Publication Data

US 2001/0019973 A1 Sep. 6, 2001

(51) Int. Cl.[7] ..... A63B 37/06
(52) U.S. Cl. ..... 473/370; 473/374
(58) Field of Search ..... 473/370, 373, 473/376, 371, 374, 377

(56) References Cited

U.S. PATENT DOCUMENTS 2,376,085 A 5/1945 Radford et al.
5,439,227 A 8/1995 Egashira et al.
5,490,674 A 2/1996 Hamada et al.
5,692,973 A 12/1997 Dalton
6,213,893 B1 * 4/2001 Maruko et al. ..... 473/370
6,217,462 B1 * 4/2001 Maruko et al. ..... 473/370

FOREIGN PATENT DOCUMENTS

JP 9-285565 11/1997

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A golf ball includes a core, an intermediate layer, and a cover. At a boundary between the core and the intermediate layer or at a boundary between the intermediate layer and the cover, convex ribs are formed in a network pattern on a first layer such that the convex ribs intrude into a second layer. In addition, columnar projections are formed on the first layer at positions corresponding to the nodes of the network pattern such that the columnar projections intrude into the second layer deeper than the convex ribs.

7 Claims, 5 Drawing Sheets

GOLF BALL

BACKGROUND OF THE INVENTION

1. Field of the Invention

The present invention relates to a multi-layer solid golf ball comprising a core, an intermediate layer, and a cover, and more particularly to a golf ball in which, at a boundary between a core and an intermediate layer or at a boundary between the intermediate layer and a cover, convex ribs and columnar projections are formed on one of the adjacent layers (the core or the intermediate layer) such that the convex ribs and the columnar projections intrude into the other layer (the intermediate layer or the cover).

2. Description of the Related Art

Various techniques have been studied and proposed for increasing travel distance of a golf ball and providing a player with an excellent feel upon hitting the golf ball (hereinafter may be called "hit feel"). Especially in a golf ball having a solid core and a cover, the hardness and size (diameter and thickness) of the core and the hardness and size of the cover are adjusted for such purposes.

For example, U.S. Pat. No. 5,439,227 discloses a three-piece golf ball which has a solid core, an inner cover, and an outer cover and in which the outer cover is made harder than the inner cover. Also, U.S. Pat. No. 5,490,674 discloses a three-piece golf ball which has inner and outer solid cores covered with a cover and in which the inner solid core is made harder than the outer solid core.

In the above-described golf balls, the boundary surface of each layer is generally a smooth spherical surface having neither projections nor depressions. However, U.S. Pat. Nos. 2,376,085 and 5,692,973 disclose a golf ball which has on its solid core a plurality of projections for preventing eccentricity of the solid core, which eccentricity could otherwise arise when a cover is formed around the core through injection molding.

The projections on the solid core of the above-described golf ball are designed to substitute support pins used in an injection molding process, and the effect obtained by the shape of the support-pin-shaped projections is not utilized to improve the performance of the golf ball. In other words, the inventions of U.S. Pat. Nos. 2,376,085 and 5,692,973 relate to a technique for preventing eccentricity of the solid core and preventing mixture of a different material into the cover. According to the technique, by employment of the same material as used for the cover, projections are formed on the core surface such that the cover has a uniform thickness, and the projections and the cover are thus united. As described above, the projections are not designed to improve the performance of the golf ball.

Also, Japanese Patent Application Laid-Open (kokai) No. 9-285565 discloses a two-piece golf ball which has projections and depressions between a solid core and a cover, between two adjacent layers of a multi-layer solid core, or between two adjacent layers of a multi-layer cover. The two-piece golf ball provides a player with different hit feels, depending on the direction of an external force acting on the golf ball during hitting.

The two-piece golf ball has improved in terms of hit feel provided to a player. However, the travel performance and durability are not satisfactory, and there is room for further improvement.

SUMMARY OF THE INVENTION

In view of the foregoing, an object of the present invention is to provide a golf ball which has an internal structure such that, at a boundary between a core and an intermediate layer or at a boundary between the intermediate layer and a cover, convex ribs and columnar projections are formed on one of adjacent layers (the core or the intermediate layer) such that the convex ribs and the columnar projections intrude into the other layer (the intermediate layer or the cover), which has an improved travel performance and controllability, as compared with a conventional golf ball, and which provides a player with an improved hit feel as compared with a conventional golf ball.

To achieve the above object, the present inventors have conducted earnest studies, taking notice that when the effect of the configuration at a boundary between the layers of a golf ball; i.e. the cross-sectional, two-dimensional moment of a member that constitutes each of the convex ribs is increased, the bending strength of the member can be increased with no corresponding increase in hardness.

As a result, the present inventors found the following with regard to a multi-layer solid golf ball in which convex ribs are formed at a boundary between adjacent first and second layers; i.e., between a core and an intermediate layer or between the intermediate layer and a cover. When convex ribs are formed in a network pattern on the first layer having a relatively high hardness such that the convex ribs intrude into the second layer having a hardness less than that of the first layer, and columnar projections are formed on the first layer at positions corresponding to the nodes of the network pattern such that the columnar projections intrude into the second layer deeper than the convex ribs, due to the effect of the shapes of the convex ribs and the columnar projections, the bending strength of the member constituting the network-shaped convex rib increases, because the member is supported by the columnar projections at positions corresponding to the nodes of the network pattern. As a result, when the golf ball is hit at a relatively high head speed by use of a driver or a like club, the degree of backspin of the golf ball decreases and the travel distance increases accordingly, whereas when the golf ball is hit at a relatively low head speed by use of a short iron or a like club, the hardness of the member does not exceed a level of hardness in conventional golf balls, yielding excellent controllability and providing soft feel.

The present invention was accomplished on the basis of the above-described findings, and provides a golf ball which comprises a core, an intermediate layer, and a cover, wherein at a boundary between the core and the intermediate layer or at a boundary between the intermediate layer and the cover, convex ribs are arranged in a network pattern on a first layer having a relatively high hardness such that the convex ribs intrude into a second layer having a hardness less than that of the first layer, the first and second layers being adjacent to each other; and columnar projections are formed on the convex ribs at positions corresponding to nodes of the network pattern such that the columnar projections intrude into the second layer deeper than the convex ribs.

The golf ball according to the present invention has the following advantageous features:

(i) When the golf ball is hit at a relatively high head speed by use of a driver or a like club, the degree of backspin of the golf ball decreases, and the travel distance increases accordingly.

(ii) When the golf ball is hit at a relatively low head speed by use of a short iron or a like club, the degree of backspin increases, so that excellent controllably is maintained.

(iii) A player is provided with a soft feel when hitting the golf ball with a driver, and is provided with a firm and solid feel when hitting the golf ball with a short iron.

(iv) In the case where the second layer is injection-molded around the first layer having the convex ribs, or in the case where the second layer is injection molded to have on its outer surface depressions corresponding to the convex ribs and the columnar projections, passages through which resin flows are secured within the cavity of a mold during the injection molding, so that the first layer having the convex ribs and the columnar projections and the second layer into which the convex ribs and the columnar projections intrude can be molded properly, imparting improved symmetry to the golf ball.

DESCRIPTION OF THE PREFERRED EMBODIMENT

Figure 1:
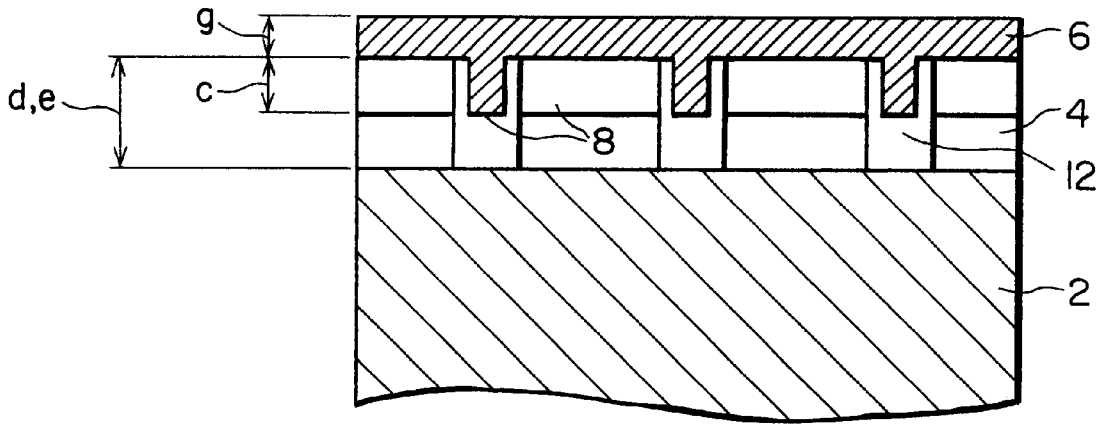
FIG. 1 is sectional view schematically showing an exemplary golf ball according to the present invention.
Figure 2:
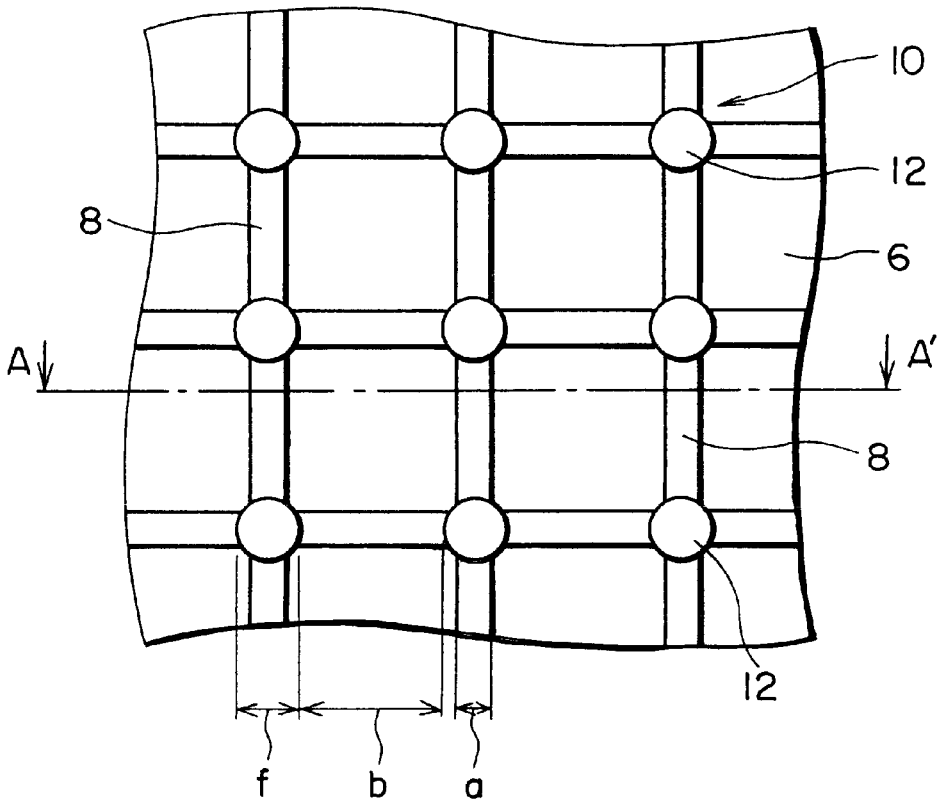
FIG. 2 is a plan view showing the surface of a layer on which convex ribs and columnar projections are formed.

The present invention will now be described in more detail with reference to the drawings. FIGS. 1 and 2 schematically show an example of a golf ball according to the present invention. FIG. 1 is a cross-sectional view taken along line A-A' in FIG. 2, and FIG. 2 is a plan view of a layer on which convex ribs and columnar projection are formed.

The golf ball according to the present invention composes a solid core 2, an intermediate layer 4 covering the solid core 2, and a cover 6 covering the intermediate layer 4. If necessary, each of the core 2 and the cover 6 may be formed to have a plurality of layers. In FIG. 1, for simplicity, the respective surfaces (outer surfaces) of the core, the intermediate layer, and the cover are illustrated to be flat. However, needless to say, each of the surfaces actually has an upwardly-projecting arcuate cross section.

Further, in the golf ball of the present invention, at the boundary between the intermediate layer 4 and the cover 6, convex ribs 8 are formed in a network pattern on the inner surface of the cover 6 such that the convex ribs 8 intrude into the intermediate layer 4. In addition, columnar projections 12 are formed on the inner surface of the cover 6 at positions 10 corresponding to the nodes of the network pattern such that the columnar projections 12 intrude into the intermediate layer 4 deeper than the convex ribs 8. The cover 6 having the convex ribs 8 is harder than the intermediate layer 4.

In the present invention, in order to prevent eccentricity of the core or catching of air, which would otherwise occur during injection molding, and in order to impart improved symmetry, inwardly projecting ribs and columnar projections are preferably formed in a network pattern on the inner surface of a layer which is provided to suppress deformation of the golf ball. That is, convex ribs and columnar projections are preferably formed in a network pattern on the inner surface of the cover such that the convex ribs and the projections project into the intermediate layer, or on the inner surface of the intermediate layer such that the convex ribs and the projections project into the core. However, alternatively, the convex ribs and columnar projections may be formed in a network pattern on the outer surface of the core so that the convex ribs and the projections project into the intermediate layer or on the outer surface of the intermediate layer so that the convex ribs and the projections project into the cover.

In the golf ball according to the present invention, the columnar projections are preferably formed at all the positions corresponding to the nodes of the network pattern. This configuration improves the above-described travel performance, controllability, and hit feel.

In the golf ball of the present invention, the width a of the convex ribs 8 is preferably 0.3–2.5 mm, more preferably 0.5–2.0 mm. When the width a of the convex ribs 8 is less than 0.3 mm, the convex ribs 8 become excessively thin, so that the effect of the convex ribs may become insufficient. When the width a of the convex ribs 8 is greater than 2.5 mm, the convex ribs 8 become excessively thick, so that the hit feel and the symmetry of the golf ball may deteriorate. The length b of the convex ribs 8 separated by means of the columnar projections 12 is preferably 3.0–15.0 mm, more preferably 4.0–10.0 mm. The height c of the convex ribs 8 is preferably 10–90%, more preferably 40–80%, of the thickness d of the second layer (in the example shown in FIG. 1, the thickness d of the intermediate layer 4). When the ratio is less than 10% the height of the convex ribs becomes excessively small, so that the effect of the convex ribs cannot be obtained sufficiently. When the ratio is more than 80%, the flowability of a molding material of the second layer during molding may deteriorate, hindering the molding of the second layer.

In the golf ball of the present invention, no limitation is imposed on the height e of the columnar projections 12. However, the height e of the columnar projections 12 is preferably substantially the same as the thickness of the second layer into which the columnar projections 12 intrude (in the example shown in FIG. 1, the thickness d of the intermediate layer 4); i.e., d=e is preferred. This configuration improves the above-described travel performance, controllability, and hit feel. Further, the maximum diameter or width f of the columnar projections 12 is preferably set to 0.5–10.0 mm, more preferably 2.0–8.0 mm.

Figure 3A:
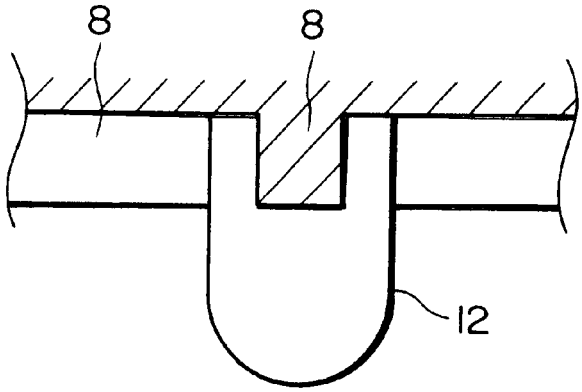
FIGS. 3A, 3B, and 3C are side views each showing an exemplary shape of the columnar projection.
Figure 3B:
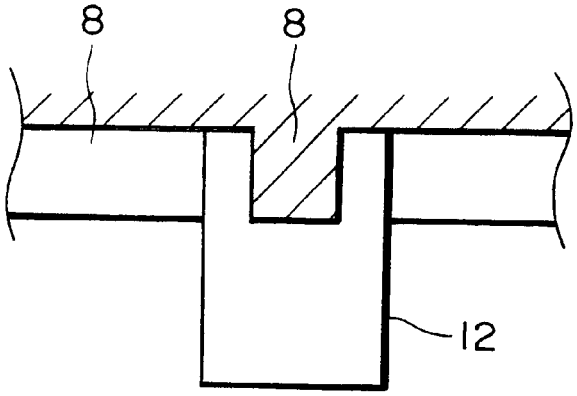
Figure 3C:
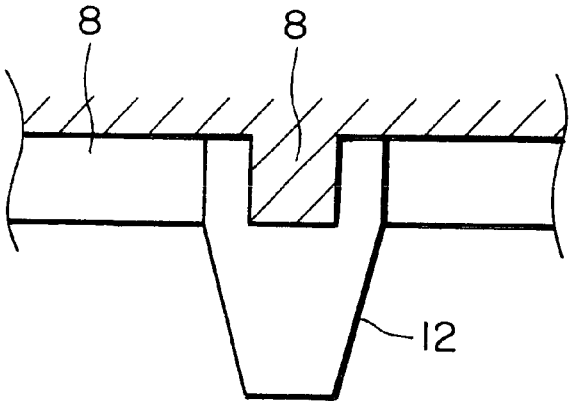

The columnar projections 12 can be formed in an arbitrary shape through selection of tools used for fabrication of a mold. For example, the columnar projections 12 may have one of the shapes shown in FIGS. 3(*a*) to 3(*c*), which are views of a columnar projection 12 as viewed from a transverse direction. Specifically, each of the columnar projections 12 may have a shape of a column having a hemispherical tip end (FIG. 3(*a*)), a shape of a circular column or prism (FIG. 3(*b*)), or a shape of a circular column having a conical tip end (FIG. 3(*c*)).

In the golf ball of the present invention, the first layer having convex ribs columnar projections must be made harder than the second layer which receives the convex ribs and the columnar projections. Specifically, the first layer having the convex ribs and the columnar projections preferably has a Shore D hardness of 58 or greater. The difference in hardness between the first layer having the convex ribs and the columnar projections and the second layer which receives the convex ribs and the columnar projections is preferably 5 or greater, more preferably 10 or greater, in Shore D hardness.

Although the arrangement of convex ribs and columnar projections is not limited to the network pattern, they are preferably formed in arrangement 1 or 2 described below. When one of these arrangements is adopted, a high degree of symmetry is realized, and molding is simplified.

Figure 4:
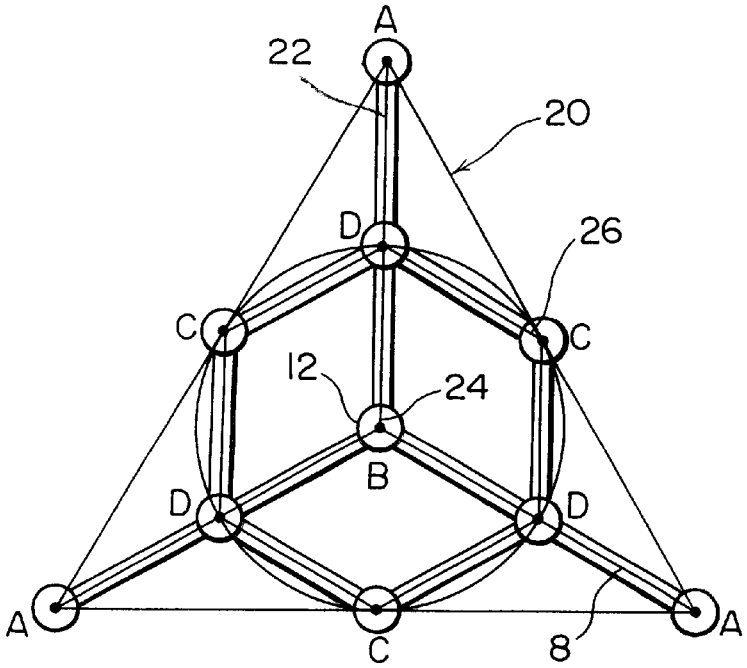
FIG. 4 is an explanatory view showing an example in which convex ribs and columnar projections are arranged in a network pattern.
Figure 5:
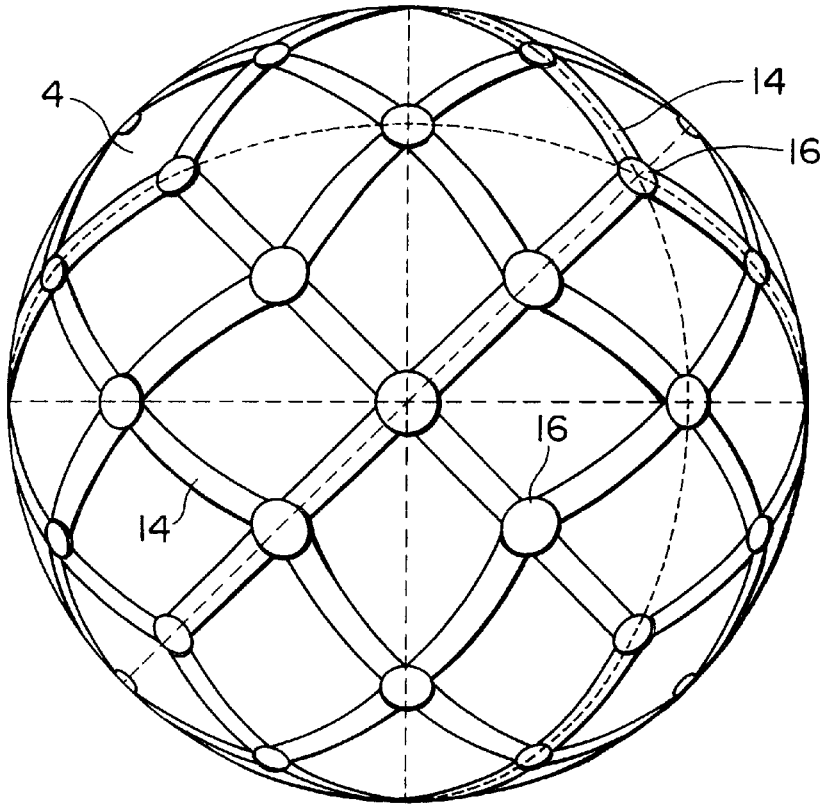
FIG. 5 is a plan view showing an example in which the outer surface of an intermediate layer has depressions corresponding to convex ribs and columnar projections formed on the inner surface of a cover.

Arrangement 1: As shown in FIG. 4, the first layer having convex ribs and columnar projections assumes the shape of a regular octahedron. When, in each spherical triangle 20, each apex is represented by A, the center (inner center; the center of an inscribed circle) is represented by B, the midpoint of each side is represented by C, and the midpoint of a line connecting the center B and each apex A is represented by D, the convex rib 8 is formed along each of a line 22 between point A and point D, a line 24 between point B and point D, and a line 26 between point C and point D. In addition, the columnar projections 12 are provided integrally with the convex ribs 8 at all positions corresponding to the nodes of the network pattern. FIG. 5 shows a specific example of Arrangement 1, in which depressions 14 corresponding to the convex ribs formed on the inner surface of the cover and depressions 16 corresponding to the columnar projections are formed on the outer surface of the intermediate layer 4 in accordance with Arrangement 1.

Figure 6:
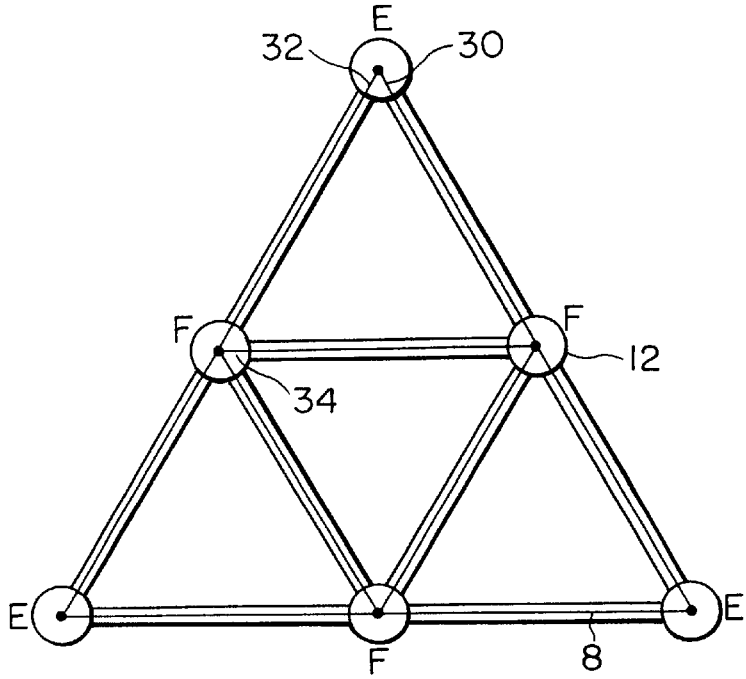
FIG. 6 is an explanatory view showing an example in which convex ribs and columnar projections are arranged in a network pattern.
Figure 7:
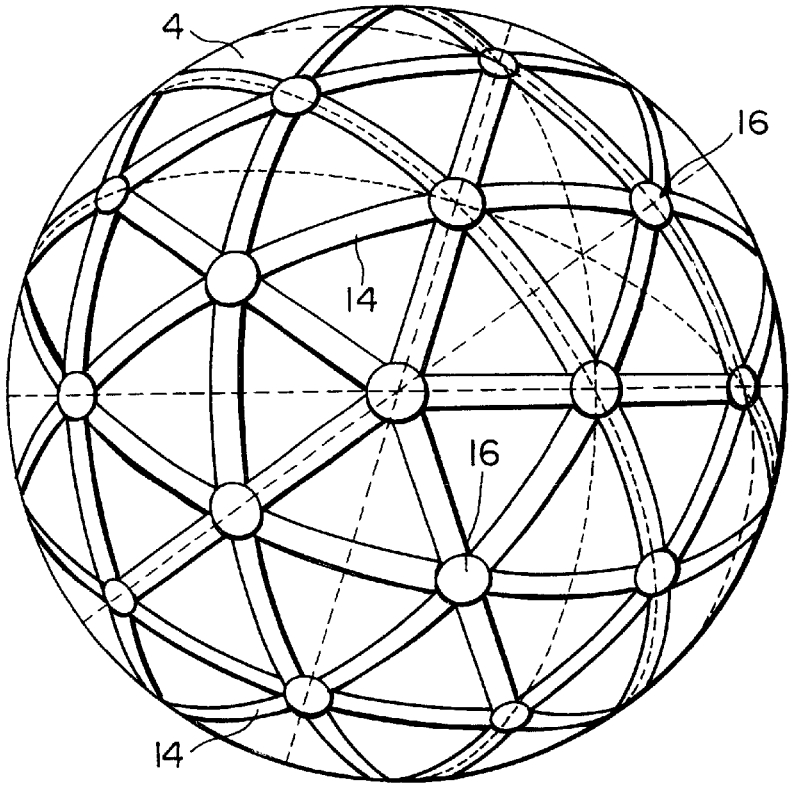
FIG. 7 is a plan view showing an example in which the outer surface of an intermediate layer has depressions corresponding to convex ribs and columnar projections formed on the inner surface of a cover.
Figure 8:
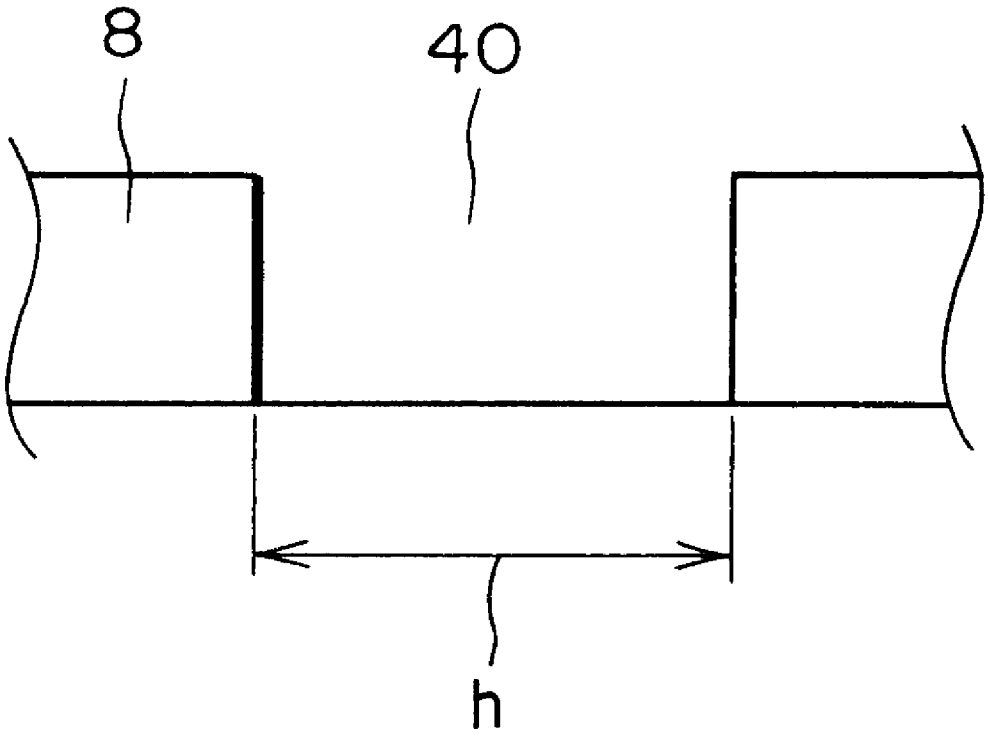
FIG. 8 is a side view showing a comparative example in which cutaways are formed in convex ribs at positions corresponding tot he nodes of the network pattern.

Arrangement 2: As shown in FIG. 6, the first layer having convex ribs and columnar projections assumes the shape of a regular icosahedron. When, in each spherical triangle 30, each apex is represented by E and the midpoint of each side is represented by F, the convex rib 8 is formed along each of a line 32 between point E and point F and a line 34 between point F and another point F. In addition, the columnar projections 12 are provided integrally with the convex ribs 8 at all positions corresponding to the nodes of the network pattern. FIG. 7 shows a specific example of Arrangement 2, in which depressions 14 corresponding to the convex ribs formed on the inner surface of the cover and depressions 16 corresponding to the columnar projections are formed on the outer surface of the intermediate layer 4 in accordance with Arrangement 2.

Next, the composition of each layer of the golf ball according to the present invention will be described. In the golf ball of the present invention, the solid core is formed of a base rubber material such as 1,4-cis-polybutadiene, polyisoprene, natural rubber, or silicone rubber, among which 1,4-cis-polybutadiene is particularly preferred, because 1,4-cis-polybutadiene can improve resilience.

A zinc or magnesium salt of an unsaturated fatty acid such as zinc methacrylate and zinc acrylate, or an ester compound such as trimethylpropane methacrylate, may be added, as a cross-linking agent, to the base rubber material, and among them, zinc acrylate is particularly preferred, because zinc acrylate can increase resilience. These linking agents are preferably incorporated in an amount of 15–40 parts by weight based on 100 parts by weight of the above-described base rubber material. Also, a vulcanizing agent may be added in an amount of 0.1–5 parts by weight based on 100 parts by weight of the base rubber material.

If necessary, zinc oxide and/or barium sulfate may be added to the base rubber material, as an antioxidant or a filler for adjusting specific gravity. The amount of the filler is 5–130 parts by weight based on 100 parts by weight of the base rubber material.

The base rubber material (a rubber composition for the solid core) preferably has the following composition:

| | |
|---|---|
| 1,4-cis-polybutadiene | 100 parts by weight |
| zinc oxide | 5–40 parts by weight |
| zinc acrylate | 15–40 parts by weight |
| barium sulfate | 0–40 parts by weight |
| peroxide | 0.1–5.0 parts by weight |

Desirable vulcanization conditions; temperature: 150±10° C., vulcanization time: 5–20 minutes.

The above-described rubber composition for the solid core is kneaded by use of a conventional mixer (for example, a Banbury mixer, a kneader, or a roll). The thus-obtained compound is molded through injection molding or compression molding employing a mold for the core.

In the present invention, when the convex ribs and the columnar projections are formed in a network pattern on the outer surface of the core, preferably the core has a multilayer structure having an inner core and a single- or multilayer outer core layer (surrounding layer) covering the inner core, and the convex ribs and the columnar projections are formed on the outer surface of the outer core layer. The inner core may be formed from the same rubber composition as the above-described rubber composition for the core. The outer core layer may be formed from a rubber material, but is preferably formed from a resin material such as an ionomer resin; an amide resin such as nylon; a urethane resin; or a polyester elastomer such as Hytrel. The ratio of the thickness (mm) of the outer core layer (the thickness of the outer core layer as measured at a portion where the convex ribs are not present) to the diameter (mm) of the inner core preferably falls within the range of 1:9–1:72, more preferably 1:11–1:36.

In the thus-obtained solid core, the diameter (when ribs are formed on the core, the height of the convex ribs is excluded) is preferably 28–38 mm, more preferably 30–37 mm; the Shore D hardness is preferably 20–50, more preferably 25–45; the deformation upon application of a load of 100 kg is preferably 2.5–5.0 mm, more preferably 3.0–4.5 mm; and the weight is typically about 12–35.0 g.

In the golf ball according to the present invention, when the convex ribs and the columnar projections are formed to extend outwardly from the core; that is, when portions of the core intrude into the intermediate layer, the convex ribs and the columnar projections are formed on the surface of the core. The convex ribs and the columnar projections can be integrally molded with the core through ordinary molding employing a mold for the core in which depressions corresponding to the convex ribs and depressions corresponding to the columnar projections are formed on the inner wall of the cavity. However, the convex ribs and the columnar projections may alternatively be formed separately from the core and then bonded onto the surface of the core.

Subsequently, the core having the convex ribs and the columnar projections is covered with a material for the intermediate layer through injection molding or compression molding (preferably injection molding), so that the convex ribs and the columnar projections intrude into the intermediate layer.

No limitation is imposed on the material of the intermediate layer. Either resin or rubber may be used, but, in view of durability, a resin having a high impact resistance is preferably used. For example, polyester elastomer, polyurethane resin, ionomer resin, styrene elastomer, hydrogenated butadiene resin, or a mixture of these materials can be used for the intermediate layer. Among them, polyester elastomer and polyurethane resin are particularly preferred, and commercially available products such as Hytrel 3078, 4047, and 4767 (products of Toray DuPont) may be used. In this case, the Shore D hardness of the intermediate layer is preferably set to 10–50, more preferably 15–45.

In the present invention, when the convex ribs and the columnar projections are formed to extend inwardly from the inner surface of the cover toward the core; that is, when portions of the cover intrude into the intermediate layer, depressions are formed on the surface of the intermediate layer during molding of the intermediate layer. Specifically, a mold for molding the intermediate layer is fabricated such that projections corresponding to the depressions are formed on the inner wall of the cavity of the mold, and the intermediate layer is molded in an ordinary manner by use of the mold. As a result, the core is covered with the intermediate layer, which has a large number of depressions on its outer surface.

It is to be noted that when a three-piece golf ball as shown in FIG. 1 having a solid core 2, an intermediate layer 4 and a cover 6 is to be manufactured, the intermediate layer 4 having a complicated shape or structure can be injection-molded by use of a resin material and a mold, without any problem. This is because an intermediate-layer-formation cavity is formed between the solid core and the inner wall of the mold such that a space having a width equal to the difference between the thickness d of the intermediate layer and the height c of the convex ribs (d-c in FIG. 1) is maintained over the entire circumferential surface of the solid core. The thickness d of the intermediate layer is preferably 1–5 mm, more preferably, 1.5–3.5 mm.

Subsequently, the intermediate layer having the depressions on its surface is covered with a material for the cover through ordinary injection or compression molding (preferably injection molding), so that convex ribs and columnar projections intrude into the intermediate layer.

No particular limitation is imposed on the cover material, and a known cover material can be used. Examples of the cover material include ionomer resin, polyurethane resin, polyester resin, and balata rubber. However, ionomer resin is preferred; more specifically, commercially available products such as Surlyn (product of DuPont) and Hi-milan (product of DuPont Mitsui Polychemicals) may be used.

If necessary, titanium dioxide, barium sulfate, or any other suitable material may be added to the cover material for the purpose of, for example, adjustment of the specific gravity. Furthermore, if necessary, an UV absorber, an antioxidant, and a dispersant such as metallic soap may be added to the cover material. The cover may be formed of a single layer made of a single material or from two or more laminated layers made of different materials.

The thickness of the cover is preferably 0.5–4.0 mm, more preferably 1.0–2.5 mm, and the Shore D hardness of the cover is preferably 40–70, more preferably 50–65.

In the thus-obtained golf ball, many dimples are formed on its surface. If necessary, coating, stamping, and other finishing treatments are performed on the surface of the golf ball. The golf ball has a hardness such that when a load of 100 kg is applied to the golf ball, the ball deforms in an amount of 2.6–4.0 mm, more preferably 2.8–3.8 mm. In compliance with the R&A golf rules, the golf ball is formed such that the golf ball has a diameter of 42.67 mm or greater and a weight of 45.93 g or less.

EXAMPLES

The present invention will be specifically described with reference to Examples and Comparative Examples. However, the present invention is not limited to the Examples. All amounts shown in Table 1 represent parts by weight.

TABLE 1

| | | Examples | | | Comparative Examples | | |
|---|---|---|---|---|---|---|---|
| | | 1 | 2 | 3 | 1 | 2 | 3 |
| Composition of core | 1,4-cis-Polybutadiene | 100.0 | 100.0 | 100.0 | 100.0 | 100.0 | 100.0 |
| | Zinc acrylate | 30.0 | 24.0 | 18.0 | 30.0 | 18.0 | 27.0 |
| | Zinc oxide | 24.5 | 27.1 | 33.0 | 24.5 | 33.0 | 22.4 |
| | Antioxidant | 0.2 | 0.2 | 0.2 | 0.2 | 0.2 | 0.2 |
| | Dicumyl peroxide | 0.9 | 0.9 | 0.9 | 0.9 | 0.9 | 0.9 |
| Composition of intermediate layer | Hytrel 4047 | 100 | 60 | — | — | 60 | — |
| | Hytrel 4767 | — | 40 | 100 | — | 40 | — |
| | Hi-milan 1605 | — | — | — | 50 | — | — |
| | Hi-milan 1706 | — | — | — | 50 | — | — |
| | Barium sulfate | — | — | — | 24 | — | — |
| Composition of cover | Hi-milan 1557 | — | 40 | 50 | — | 40 | — |
| | Hi-milan 1601 | — | — | 50 | — | — | — |
| | Hi-milan 1605 | 50 | — | — | 50 | — | 50 |
| | Hi-milan 1706 | 50 | — | — | 50 | — | 50 |
| | Hi-milan 1856 | — | 60 | — | — | 60 | — |

Hytrel: product of Toray DuPont, polyester-based thermoplastic elastomer
Hi-milan: product of DuPont Mitsui Polychemicals, ionomer resin

Examples and Comparative Examples

Golf balls of Examples 1–3 and Comparative Examples 1–3 were manufactured as follows. First, a solid core for each golf ball was produced. That is, a rubber composition for the solid core having a corresponding composition shown in Table 1 was kneaded by use of a kneader, and vulcanaized for about 15 minutes at 155 C.° within a mold for the core.

Subsequently, a composition for an intermediate layer having a corresponding composition shown in Table 1 was kneaded and injection-molded around the solid core to thereby form the intermediate layer. Subsequently, a cover material having a composition shown in Table 1 was injection-molded around the intermediate layer to thereby form the cover. Subsequently, ordinary coating was applied to the cover. In this way, the golf balls of Example 1–3 and Comparative Examples 1 and 2 were completed. In the case of the golf ball of Example 3, a cover material having a composition shown in Table 1 was injection-molded directly around the core to complete the golf ball.

The mold used for molding of the intermediate layer in Examples 1–3 had protrusions which were formed on the inner wall of the cavity and which corresponded to convex ribs and columnar projections, and thus depressions corresponding to the convex ribs and the columnar projections were formed on the outer surface of the intermediate layer during molding of the intermediate layer. The cover material intruded into these depressions, and thus convex ribs and the columnar projections were formed in the intermediate layer. The height of the columnar projections was made equal to the thickness of the intermediate layer. The thus-formed convex ribs and columnar projections were arranged in a network pattern of the above-described Arrangement 1 (regular octahedron arrangement).

Travel Performance Test

Each golf ball was hit by a swing robot at the below-described speed, and initial speed, travel distance, and spin were measured. The driver used in the test was a Tour Stage X100 (product of Bridgestone Sport).

(1) Driver (W#1), head speed: 45 m/s (HS45), loft: 11°

(2) Driver (W#1), head speed: 35 m/s (HS35), loft: 14°

Hit-Feel Test

The golf balls were subjected to sensory evaluation test for hit feel in which three professional golfers hit the golf balls with a driver and evaluated hit feel. Evaluation criteria for hit feel are as follows:

◎: Outstanding

○: Excellent

Δ: Good

×: Poor

TABLE 2

| | | Examples | | | Comparative Examples | | |
|---|---|---|---|---|---|---|---|
| | | 1 | 2 | 3 | 1 | 2 | 3 |
| Ball configuration | | 3P | 3P | 3P | 3P | 3P | 2P |
| Core | Diameter (mm) | 35.3 | 34.5 | 32.7 | 35.3 | 32.7 | 38.7 |
| | Weight (g) | 27.4 | 25.6 | 22.2 | 27.4 | 22.2 | 35.5 |
| | Hardness (mm) *1 | 2.8 | 3.4 | 4.2 | 2.8 | 4.2 | 3.4 |
| Intermediate layer | Diameter (mm) | 38.7 | 38.7 | 38.9 | 38.7 | 38.9 | — |
| | Thickness (mm) | 1.70 | 2.10 | 3.10 | 1.70 | 3.10 | — |
| | Weight (g) *2 | 35.6 | 35.5 | 36.2 | 35.6 | 36.2 | — |
| | Shore D hardness | 40 | 40 | 40 | 65 | 40 | — |
| Cover | Diameter (mm) | 42.7 | 42.7 | 42.7 | 42.7 | 42.7 | 42.7 |
| | Thickness (mm) | 2.00 | 2.00 | 1.90 | 2.00 | 1.90 | 2.00 |
| | Weight (g) *3 | 45.3 | 45.2 | 45.4 | 45.3 | 45.4 | 45.2 |
| | Shore D hardness | 65 | 65 | 65 | 65 | 65 | 65 |
| | Rib shape | ○ | ○ | ○ | ○ | X | X |
| | Width (mm) | 1.00 | 1.50 | 1.00 | 1.00 | — | — |
| | Height (mm) | 1.20 | 1.60 | 2.40 | 1.40 | — | — |
| | Projection shape | Circular column | Circular column | Circular column | Circular column | — | — |
| | Diameter (mm) | 2.00 | 2.30 | 2.50 | 2.00 | — | — |
| | Height (mm) | 1.70 | 2.10 | 3.10 | 1.70 | — | — |
| W#1 HS 45 m/s | Spin (rpm) | 2270 | 2410 | 2480 | 2010 | 2630 | 2750 |
| | Initial speed (m/s) | 63.7 | 63.6 | 63.6 | 63.4 | 63.4 | 63.3 |
| | Carry (m) | 209.0 | 208.1 | 209.2 | 203.1 | 206.6 | 205.4 |
| | Total distance (m) | 230.4 | 227.5 | 228.9 | 223.7 | 224.2 | 223.2 |
| | Hit feel | ◎ | ◎ | Δ | X | Δ | A |
| W#1 HS 35 m/s | Spin (rpm) | 3300 | 3520 | 3560 | 2950 | 3790 | 3950 |
| | Initial speed (m/s) | 50.6 | 50.5 | 50.6 | 50.3 | 50.4 | 50.2 |
| | Carry (m) | 147.1 | 146.5 | 146.8 | 144.3 | 145.7 | 143.1 |
| | Total distance (m) | 160.4 | 159.6 | 159.0 | 156.1 | 156.3 | 155.6 |
| | Hit feel | ◎ | ◎ | ◎ | X | Δ | X |

*1 Deformation upon application of a load of 100 kg
*2 Core + intermediate layer
*3 Core + intermediate layer + cover In the golf ball of Comparative Example 1, columnar projections are formed at positions corresponding to the nodes of the network as in the case of Examples 1 to 3, but the cover having the ribs and the projections is formed to have the same Shore D hardness as the intermediate layer. In the golf balls of Comparative Examples 2 and 3, a smooth spherical surface having no unevenness is formed at the boundary between the intermediate layer and the cover (Comparative Example 2) or at the boundary between the core and the cover (Comparative Example 3).

Subsequently, the thus obtained golf balls were evaluated in terms of travel performance and hit feel, in accordance with the method described below. The results are shown in Table 2.

What is claimed is:

1. A golf ball comprising a core, an intermediate layer, and a cover, wherein at a boundary between the core and the intermediate layer or at a boundary between the intermediate layer and the cover, convex ribs are formed in a network pattern on a first layer having a relatively high hardness such that the convex ribs intrude into a second layer having a hardness less than that of the first layer, the first and second layers being adjacent to each other; and columnar projections are formed on the first layer at positions corresponding to nodes of the network pattern such that the columnar projections intrude into the second layer deeper than the convex ribs.

2. A golf ball according to claim 1, wherein the columnar projections are formed on the first layer at all the positions corresponding to the nodes of the network pattern.

3. A golf ball according to claim 1, wherein the convex ribs have a height which is 10–90% of the thickness of the second layer.

4. A golf ball according to claim 1, wherein the convex ribs have a width of 0.3 to 2.5 mm.

5. A golf ball according to claim 1, wherein the columnar projections have a height substantially equal to the thickness of the second layer.

6. A golf ball according to claim 1, wherein the columnar projections each have a maximum diameter or width of 0.5 to 10.0 mm.

7. A golf ball according to claim 1, wherein the difference in hardness between the first and second layers is 5 or greater in Shore D hardness.

* * * * *